US008502636B2

(12) United States Patent
Striebig et al.

(10) Patent No.: US 8,502,636 B2
(45) Date of Patent: Aug. 6, 2013

(54) BY-PASS OF AN ELECTRICAL COMPONENT

(75) Inventors: Jean-Louis Striebig, Ormesson sur Marne (FR); Pierre Savaro, Combs la Ville (FR)

(73) Assignee: Souriau, Versailles (FR)

( * ) Notice: Subject to any disclaimer, the term of this patent is extended or adjusted under 35 U.S.C. 154(b) by 449 days.

(21) Appl. No.: 12/303,378

(22) PCT Filed: Nov. 17, 2006

(86) PCT No.: PCT/EP2006/011063

§ 371 (c)(1),
(2), (4) Date: Sep. 9, 2010

(87) PCT Pub. No.: WO2007/140810

PCT Pub. Date: Dec. 13, 2007

(65) Prior Publication Data

US 2011/0006875 A1 Jan. 13, 2011

(30) Foreign Application Priority Data

Jun. 7, 2006 (FR) ..... 06 05032
Jun. 7, 2006 (FR) ..... 06 05033

(51) Int. Cl.
*H01H 37/76* (2006.01)
*H01H 47/00* (2006.01)
*H01H 35/00* (2006.01)

(52) U.S. Cl.
USPC ..... 337/409; 337/401; 337/407; 337/408; 307/125; 200/52 R

(58) Field of Classification Search
USPC .. 337/401, 407, 408, 409; 307/125; 200/52 R
See application file for complete search history.

(56) References Cited

U.S. PATENT DOCUMENTS

| | | | | |
|---|---|---|---|---|
| 1,439,707 | A | 12/1922 | Newell | |
| 3,388,933 | A | 6/1968 | Phillips | |
| 3,428,064 | A | 2/1969 | Phillips et al. | |
| 3,924,688 | A | 12/1975 | Cooper et al. | |
| 4,042,795 | A | 8/1977 | Sykora | |
| 4,153,893 | A * | 5/1979 | Swanson | 337/201 |

(Continued)

FOREIGN PATENT DOCUMENTS

| | | | |
|---|---|---|---|
| CH | 96951 | A | 11/1922 |
| FR | 2812761 | A1 | 2/2002 |

OTHER PUBLICATIONS

International Search Report dated Feb. 28, 2007.

*Primary Examiner* — Bradley Thomas
(74) *Attorney, Agent, or Firm* — Perman & Green, LLP

(57) ABSTRACT

A modular by-pass device of an electrical component includes a housing possessing a movable means of sealing, and is equipped with conducting terminals, one of whose ends is connected to one of the terminals of the electrical component circuit, the other end being fastened to the wall of the housing projecting into the interior of the housing and constituting a contact post. An actuator providing transposition between two positions of a control device include a plunger shaft and a spring arranged in the space formed between the plunger shaft and the internal wall of the housing. A trigger includes a retention device of the plunger shaft held in place by a fusible material. A reversing switch includes a contact zone providing electrical continuity between two contact posts of the terminals carried by the housing. The disclosed embodiments finds application more particularly in the isolation and short-circuiting of a battery element, which has become defective.

15 Claims, 5 Drawing Sheets

U.S. PATENT DOCUMENTS

| | | | | | |
|---|---|---|---|---|---|
| 4,189,697 | A | * | 2/1980 | Hara | 337/407 |
| 4,210,893 | A | * | 7/1980 | Hara | 337/407 |
| 4,220,942 | A | * | 9/1980 | Meister et al. | 337/277 |
| 4,281,309 | A | * | 7/1981 | Olson | 337/409 |
| 4,511,876 | A | * | 4/1985 | Urani | 337/244 |
| 4,727,347 | A | * | 2/1988 | Cambio et al. | 337/165 |
| 4,992,770 | A | * | 2/1991 | Spalding et al. | 337/164 |
| 5,043,689 | A | * | 8/1991 | Di Troia et al. | 337/165 |
| 5,206,775 | A | * | 4/1993 | Wilson | 361/15 |
| 5,362,576 | A | | 11/1994 | Clark et al. | |
| 5,438,173 | A | * | 8/1995 | Rudoy et al. | 200/52 R |
| 5,471,888 | A | | 12/1995 | McCormick | |
| 5,612,663 | A | * | 3/1997 | Hollweck | 337/407 |
| 5,960,674 | A | | 10/1999 | Brockmeyer | |
| 6,093,896 | A | * | 7/2000 | Wu et al. | 200/52 R |
| 6,249,063 | B1 | * | 6/2001 | Rudoy et al. | 307/125 |
| 6,356,056 | B2 | | 3/2002 | Dowen et al. | |
| 6,405,757 | B1 | | 6/2002 | Jabcon | |
| 6,525,920 | B2 | | 2/2003 | Rudoy et al. | |
| 6,896,305 | B1 | | 5/2005 | Wu et al. | |
| 2005/0194149 | A1 | | 9/2005 | Giacomino | |
| 2008/0117015 | A1 | * | 5/2008 | Leach | 337/238 |

* cited by examiner

Fig. 7a
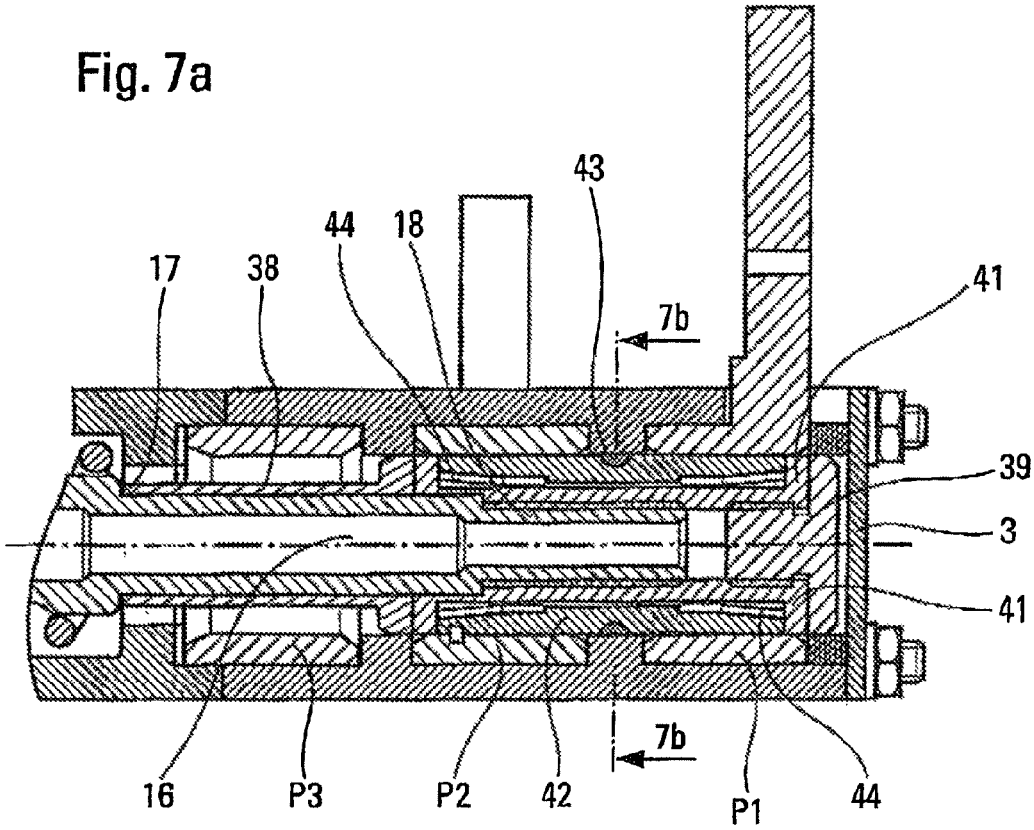
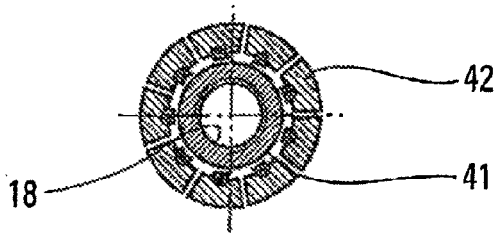
Fig. 7b

BY-PASS OF AN ELECTRICAL COMPONENT

CROSS REFERENCE TO RELATED APPLICATIONS

This application is the National Stage of International Application No. PCT/EP2006/011063 International Filing Date, 17 Nov. 2006, which designated the United States of America, and which International Application was published under PCT Article 21 (2) as WO Publication No. WO2007/140810 and which claims priority from French Application No. 0605033 and 060532 both filed on 7 Jun. 2006, the disclosures of which are incorporated herein by reference in their entireties.

BACKGROUND

1. Field

The disclosed embodiments concern a by-pass device of an electrical component, such as a module by-pass device, and more particularly a thermally activated by-pass device using a control current. It finds application more particularly in the isolation and short-circuiting of a battery element, which has become defective.

2. Brief Description of Related Developments

Protection against defective batteries has been the subject of numerous studies, in particular of difficult to access batteries, such as those on board space missiles.

In fact, when a battery element becomes defective, it is imperative to isolate it so that it shall not impair the functioning of sound battery elements, which may continue to work and to supply potential to the circuit, which the battery has to supply.

Generally speaking, by-pass devices also called battery by-passes, consist of an actuator, a trigger and a reversing switch located in a housing, each of these three components possessing its own function. Thus, the actuator is a mechanical device, which has to be able to provide the transposition between two positions of a control device called a shaft or a plunger. The trigger is a mechanical device comprising a fusible material, which when subjected to an electric control current producing a rise in temperature will melt or break in order to set free the actuator. The reversing switch is a device, which provides in each of its two positions electrical continuity between two of the three terminals carried by the housing and connected to the battery element circuit terminals.

At one of its ends, the shaft generally speaking comprises a flange, which serves as a stop to a spring located in the space provided between the shaft and the internal wall of the housing. This space comprises a circular shoulder cut the internal surface of the housing in such a way as to trap the spring between the shaft collar and the circular shoulder. The spring is thus kept in compression, whilst the shaft is held in sheathed position by the trigger, that is to say, when the shaft holds the reversing switch in its normal position of functioning and when electrical continuity between the two first terminals is provided. In the event of the dysfunction of a battery element, the trigger is actuated and thereby sets free the shaft. The latter is then transposed from its sheathed position to the freed position under the pressure of the spring. This position freed by the trigger makes it possible for the shaft to bring the reversing switch into a position of isolation of the failed battery element by providing electrical continuity between a first and a second terminal.

Triggers which use a fusible material, which melts or breaks on a rise in temperature of the material by the passage of an electric current, are well known.

This principle is described in U.S. Pat. No. 3,388,933, which deals with a trigger comprising a fusible element, which keeps half-shells able to be separated for the purpose of the maintenance and the setting free of a voluminous object fixing hoop.

An application of this principle is, in particular, disclosed by U.S. Pat. No. 3,924,688, which describes the setting free of an actuator shaft kept in contact by two locked half-shells by means of a wire coil under strain, whose slackening is controlled by the melting of a fusible element. The slackening of the coil makes possible the separation of the two half-shells and hence the setting free of the shaft.

An improvement to this principle is disclosed in U.S. Pat. No. 5,471,888, which describes an embodiment comprising two half-shells and an insulator on which the fusible element is placed.

The technology of actuators making possible the separation of an element of a battery when the latter exhibits an anomaly, by a physical separation of the two parts of an assembly, thanks to the melting of an element reacting to an electrical threshold, is likewise well known.

U.S. Pat. No. 5,362,576 concerns a conducting plunger placed between two terminals constituting the ends of an insulating cylinder. An output terminal is connected to the battery element. When it is functioning normally, the plunger is kept in electrical contact with the terminal through a fusible element. The current then passes between the terminals through the plunger, which also comprises peripheral contacts in the form of metal sleeves. When an electric threshold is exceeded, corresponding to an increase of the internal resistance of the battery element, the thermal element weakens, melts and breaks. The plunger is then propelled through the relaxing of the strain of the spring and after having broken the electrical continuity between the first terminals, provides a by-pass connection by connecting the first and second terminal.

U.S. Pat. No. 5,438,173 deals with a battery by-pass device comprising a mobile mounting consisting of a base, a compression spring, an element comprising erasable arms, which hold in place a plunger. The said plunger is equipped with a freeing means which comes into play in the case of a failure via the erasure of the arms, thus setting free the mobile mounting and making it possible to establish an electrical by-pass circuit.

U.S. Pat. No. 6,249,063 discloses a conducting half-shaft, carrying toroidal contacts, mechanically connected to an insulating half-shaft providing electrical continuity between the terminals, the plunger connected mechanically to the insulating half-shaft being held by two half-shells, themselves held in contact by a wire coil under strain, the said strain being released when a fusible element on its electrical threshold is destroyed. More particularly this document describes a modular by-pass device of an electrical component comprising a housing possessing a movable means of sealing and equipped with conducting terminals, one of whose ends is connected to one of the terminals of the electrical component circuit, the other end being fastened to the wall of the housing projecting into the interior of the housing and constituting a contact post, an actuator providing transposition between two positions of a control device consisting of a plunger shaft and comprising a spring arranged in the space formed between the plunger shaft and the internal wall of the housing, a trigger comprising a retention device of the plunger shaft held in place by a fusible material, a reversing switch comprising a contact zone providing electrical continuity between two contact posts of the terminals carried by the housing.

All the embodiments described in the prior art use a relatively large number of parts, which may become separated when used in demanding environments, which are costly to assemble and which cannot be used in all models required by customers. Moreover, the said large number of parts does not make possible easy on-site assembly, maintenance or repair of the devices.

There is accordingly a need to provide a modular by-pass device of an electrical component offering a high degree of flexibility in use, for the adaptation, the introduction and the replacement of different components.

Such a device must be modular and must moreover make possible absolute safety, in order to avoid during the assembly and fitting in workshops, any danger of untimely triggering. Lastly, in the event of untimely triggering, the device must make possible the repositioning of components without complete dismantling.

SUMMARY

The aspect of the disclosed embodiments is that of making possible easy adaptation, fitting, fastening and replacement of different types of trigger as well as different types of reversing switches at the end in question of plunger shafts.

This is the reason why the disclosed embodiments concern a modular by-pass device of an electrical component comprising a housing possessing movable means of sealing and equipped with conducting terminals, one of whose ends is connected to one of the electrical component circuit terminals, the other end being fastened on the housing wall, projecting the interior of the housing and constituting a contact post, an actuator able to provide transposition between two positions of a control device consisting of a plunger shaft and comprising a spring arranged in the space formed between the plunger shaft and the internal wall of the housing, a trigger comprising a retention device of the plunger shaft held in place by a fusible material, a reversing switch comprising a zone of contact providing electrical continuity between two contact posts of terminals carried by the housing, a by-pass device in which the plunger shaft of the actuator is a one-piece shaft.

According to the disclosed embodiments, the plunger shaft comprises at one of its ends a cylindrical portion in the form of a barrel provided with a central bore forming a seating.

According to the disclosed embodiments, the trigger comprises an adapter held in place by friction within the bore of the central seating.

According to a variant of the disclosed embodiments, the open end of the seating is provided with a thread on its interior surface.

According to the said variant, the trigger comprises an adapter held in place by screwing the plunger shaft into the thread of the seating.

According to a first embodiment, the adapter comprises a thread, which receives a screw forming a torque kept in a locked position by at least one tappet acting in concert with at least one turn of the screw fitted in a coil and kept in locked position by a retaining wire hooked onto a fusible element.

According to a second embodiment, the adapter comprises a post carrying an ogival pin supported on at least one tappet fitted in a coil and kept in locked position by a retaining wire hooked on a fusible element.

Using these two methods, when the fusible element melts, the tappets separate by a lateral sliding movement.

According to a third embodiment, at least one tappet comprises an arm whose edge supports itself in a groove of the end portion of the trigger. Using this method, when the fusible element melts, the tappet separates by a pivoting movement.

The disclosed embodiments also concern a modular by-pass device of an electrical component comprising a housing possessing a movable means of sealing and equipped with conducting terminals, one of whose ends is connected to one of the electrical component circuit terminals, the other end being fastened to the housing wall and projecting into the interior of the housing and constituting a contact post, an actuator providing the transposition between two positions of a control device consisting of a plunger shaft and comprising a spring arranged in the space formed between the plunger shaft and the interior wall of the housing, a trigger comprising a plunger shaft retention device held in place by a fusible element, a reversing switch comprising a contact zone providing electrical continuity between two contact posts of terminals carried by the housing, a by-pass device in which the plunger shaft of the actuator is a one-piece shaft.

According to the disclosed embodiments, the plunger shaft comprises at one of its ends a cylindrical portion in the shape of a pin provided with a threaded portion.

According to a preferred embodiment, the plunger shaft is made of a conducting material and according to a variant, the plunger shaft is made of an insulating material.

According to a preferred embodiment, the reversing switch is equipped with a jacket, which, if it is conducting, provides electrical continuity between the posts according to the position of the plunger shaft.

According to this embodiment, an insulating strut and an insulating shim provide the positioning and the locking of the conducting jacket.

According to a first embodiment, the contact posts are equipped with a circular metal contacts strip projecting into the housing space.

According to a second embodiment, the conducting jacket comprises recesses for positioning the circular metal contacts strip projecting into the housing space.

According to a third embodiment, the jacket has the form of a key reception seating made of a conducting material providing electrical continuity between the posts according to the position of the plunger shaft.

According to this embodiment, the keys are kept in place using a snap ring and kept in compression using springs placed in the seating and acting on the keys. In a variant, the spring is an individual one, either attached or incorporated.

BRIEF DESCRIPTION OF THE DRAWINGS

The disclosed embodiments shall be better understood with the help of the following description and drawings, which are appended thereto and in which

FIGS. 7*a* and 7*b* are a section of a reversing switch element according to a third embodiment.

DETAILED DESCRIPTION OF THE DISCLOSED EMBODIMENTS

Figure 1:
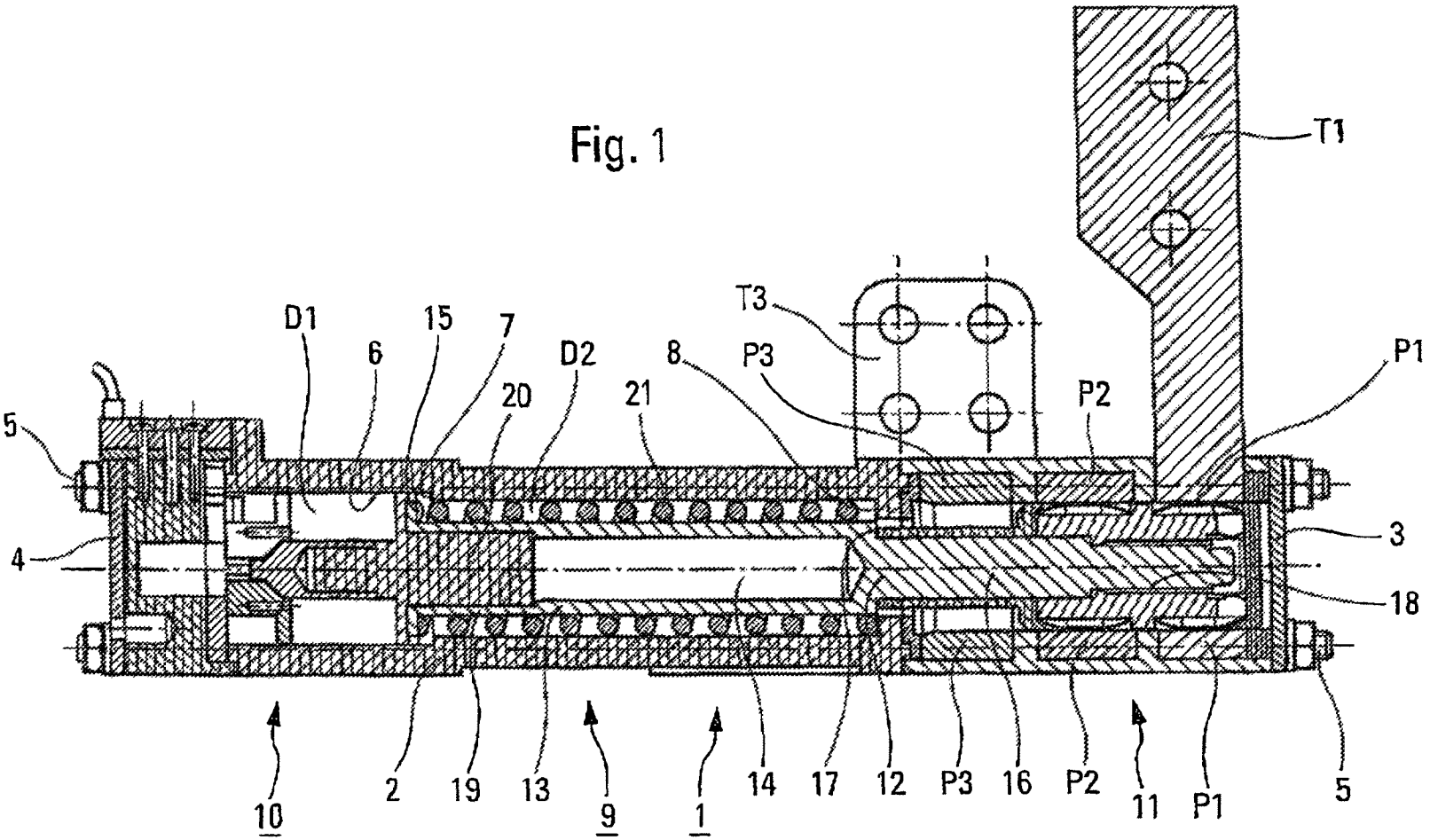
FIG. 1 is a section of an embodiment of the by-pass.

The by-pass device, by-pass 1 comprises a cylindrical housing 2 made from an insulating material provided at its ends with movable means of sealing 3 and 4, fastened to a cylindrical wall with the help of dowels 5. Terminals T1 and T3 pass through the wall of housing 2 and it should be noted that T2 is not shown in FIG. 1. These terminals, which provide the supply for T1 and T2 and the by-pass function for terminals T2 and T3, are connected by their end located outside the housing to the circuit terminals of the battery element, which is not shown. The annular end of each of the terminals T1, T2 and T3 located inside housing 2 provides a contact post P1, P2 and P3, whose role is described below.

Housing 2 comprises on its interior surface 6, two shoulders 7 and 8, which correspond to the change of diameter between internal sections D1 and D2 of housing 2.

Housing 2 is provided for receiving the three elements constituting the by-pass, namely, an actuator 9, a trigger 10 and a reversing switch 11, which make it possible to isolate with the help of a control current, a battery element which has become defective and so ensure the correct functioning of the remaining cells of the battery.

Each of these three elements possesses its own function.

Actuator 9 is a mechanical device, which provides a transposition between two positions of a control device called plunger shaft 12. Trigger 10 is a device comprising retention means and having a fusible material, which, when it is subjected to an electric current producing a rise in temperature, melts or breaks in order to set free the actuator 9. Reversing switch 11 is a device providing in each of its two positions an electrical continuity between the three terminals T1, T2 and T3 connected to battery element circuit terminals.

According to the embodiment shown in FIG. 1, the by-pass comprises the housing 2 made of insulating material inside which is positioned and guided the plunger shaft 12, which is electrically conducting and able to be transposed. Clearly, according to the design of the model requested by the customer, the plunger shaft can be made from insulating material. In both cases, the plunger shaft 12 is a one-piece shaft.

The plunger shaft 12 comprises at its end, which is contiguous with the part of the housing receiving the actuator 10, a cylindrical portion in the form of barrel 13, provided with a central bore forming a seating 14. The open end of the seating 14 is provided with a collar forming a flange 15 oriented towards the exterior of the seating. The plunger shaft 12 comprises at the end contiguous with the part of the housing receiving the reversing switch 11, a cylindrical part in the form of a pin 16. The plunger shaft comprises in it central part a shoulder 17 formed by the difference of the respective diameters of the cylindrical parts of the pin 16 and the barrel 13, the said shoulder constituting an end-of-travel stop of the means of positioning and locking of the parts of the reversing switch 11. The pin 16 is also provided on its exterior surface with a thread 18, which makes possible the easy replacement and fastening of reversing switch parts.

The open end of seating 14 makes possible the easy replacement and fastening of parts, which equip the trigger 10 thanks to its central bore. Generally speaking, these parts consist of an adapter 20 such as a plug made from insulating or other material, which supports the flange 15 of the seating and which through friction provides the holding in place of parts of the trigger in the interior of the seating. In a variant, the seating comprises a thread 19, which makes possible the replacement and fastening of parts thanks to a bolt, which is able to screw the adapter fully into the thread 19.

To provide the transposition of the plunger shaft 12 between a sheathed position, that is to say when the plunger shaft is kept functioning normally by the trigger 10 and when the posts P1 and P2 are connected, a spring 21 is arranged coaxially on the external surface of the cylindrical portion of the barrel 13. The said spring 21 is kept in compression in the space D2 formed between the exterior surface of the shaft and the internal wall 6 of the housing, between the flange 15 of the barrel of the plunger shaft and the circular shoulder 8 made on the internal surface of the housing. When trigger 10 comes into play, that is to say, during the abnormal functioning of a battery element, the slackening of the spring 21 moves the plunger shaft into the space D1 where parts of the trigger are positioned and the posts P2 and P3 are then connected.

Figure 2A:
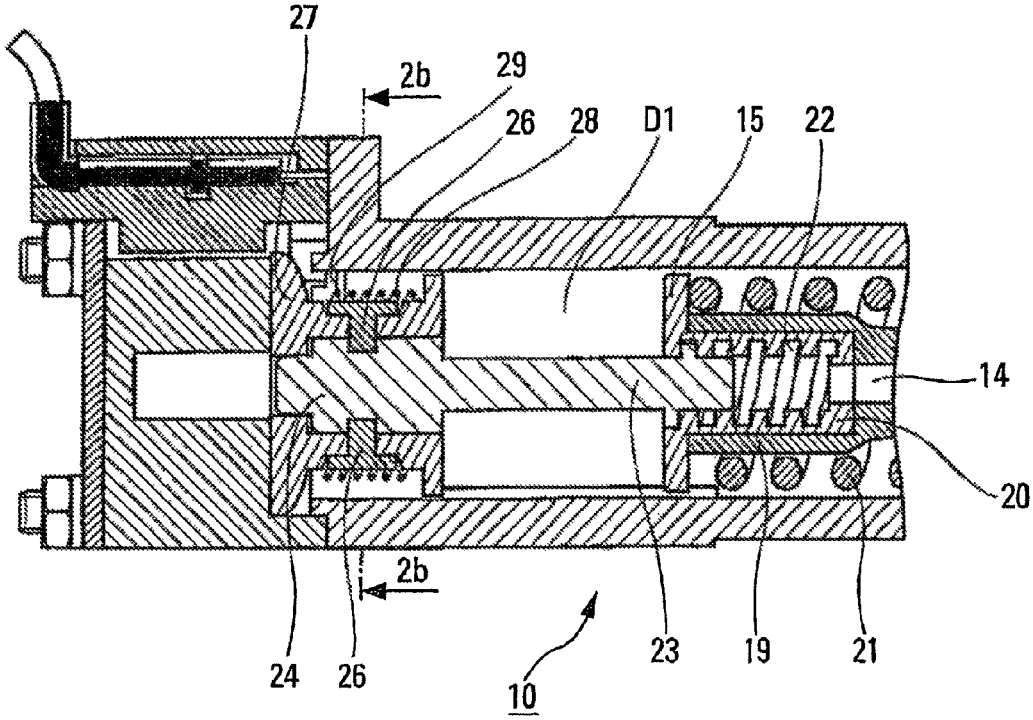
FIGS. 2*a* and 2*b* are a section of a trigger element according to a first embodiment.
Figure 2B:
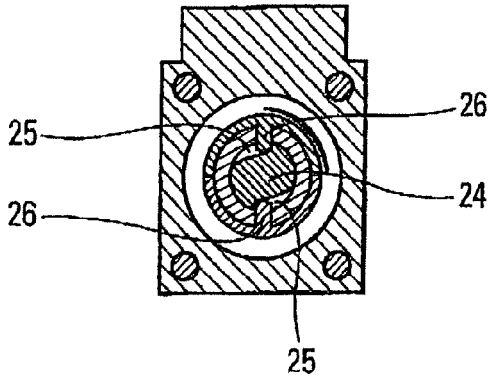

FIGS. 2*a* and 2*b* show a first embodiment of the trigger 10, in which the bolt is screwed into the thread 19 of the seating 14. The said bolt comprises a collar, which serves as collar 15 and is provided on its central axis with a thread 22, supporting a screw 23 and thus generates a torque. The bolt is locked in rotation in a groove cut into the internal wall of the housing, into which it slides.

The screw 23 comprises a cylindrical part 24 in which grooves 25 have been cut and have a cam section, which can be seen in FIG. 2*b*, in which tappets 26 keep the screw 23 locked in a torque.

The tappets 26 are assembled in a coil 27 and are held in a locked position by a retaining wire 28 hooked on one side on the coil and on the other side on fusible wire or brace 29.

When an electric current exceeding a certain threshold value passes through the fusible element 29, the latter melts, sets free the retaining wire 28, which unrolls and makes possible separation of the tappets 26 by a lateral slide movement, thanks to the torque generated by the screw 23 and the thread 22 of the bolt and to the cam section of the supporting surface 25 with the end of the tappets 26.

According to this embodiment, the tappets 26 are two in number and are fitted in an opposing manner. Nevertheless, depending on the size of the application, the use of one or more tappets is possible.

In a variant, the link via a bolt may be located in the interior of the cylindrical part 24, the screw then forming part of the plunger shaft, or of an insulating part at the end of the shaft. It should also be noted that in the case of a shaft made of a conducting material, it is necessary to insulate the trigger/shaft link in order to prevent the potential of the terminals of the reversing switch from interfering with the potential of the fusible wire of the trigger.

Figure 3B:
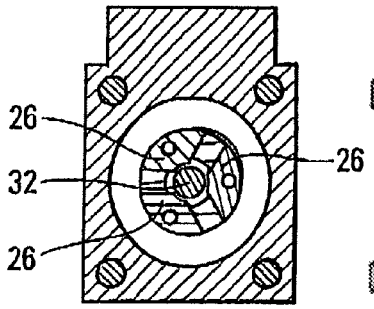
FIGS. 3*a* and 3*b* are a section of a trigger element according to a second embodiment.
Figure 3A:
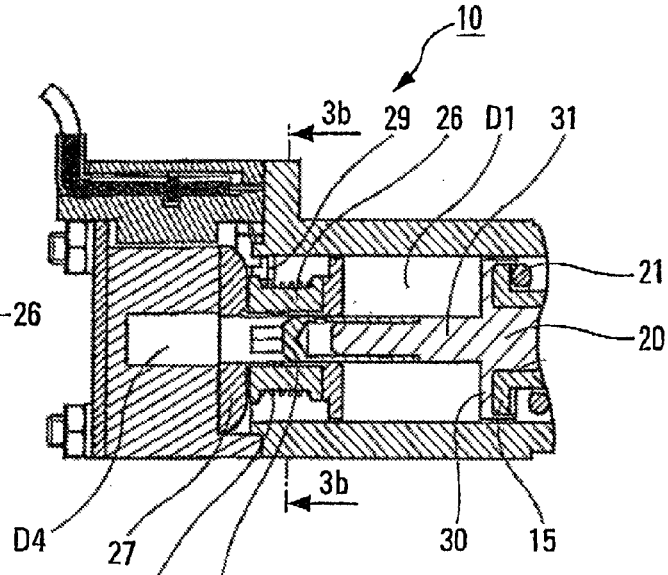

FIGS. 3*a* and 3*b* show a second embodiment of the trigger 10, in which the adapter 20 nests in the central bore of seating 14. The adapter 20 which is made of an insulating material, comprises an insulating collar 30, which supports and covers the flange 15 and apart from insulating, guides the plunger shaft 12 during its movement into the space D1. The adapter 20 comprises opposite its shrunk-on part, a post 31 on which is fastened an ogival or conical metal pin 32. The metal pin rests against the tappets 26, which number three in the present embodiment, such as can be seen in FIG. 3*b*. As in the preceding embodiment, the tappets 26 are guided into a coil 27 and are held in place by a retaining wire 28 hooked on one side on the coil and on the other side to the fusible element 29. According to this embodiment, the tappets 26 are three in number and are fitted in opposition to one another. Nevertheless, depending on the size of the application, the use of a single or several tappets is possible in conjunction with a bevelled metal pin.

When an electric current exceeding a certain threshold value passes through the fusible element 29, the latter melts, sets free the retaining wire 28 which unrolls and makes possible a lateral sliding movement of the tappets 26 between the flanges of the coil, thanks to the form of the support between the metal pin 32 and the interior bevelled part of the tappets 26, the metal pin 32 now moving into the space D4 formed in the end part of the trigger 10.

Figure 4:
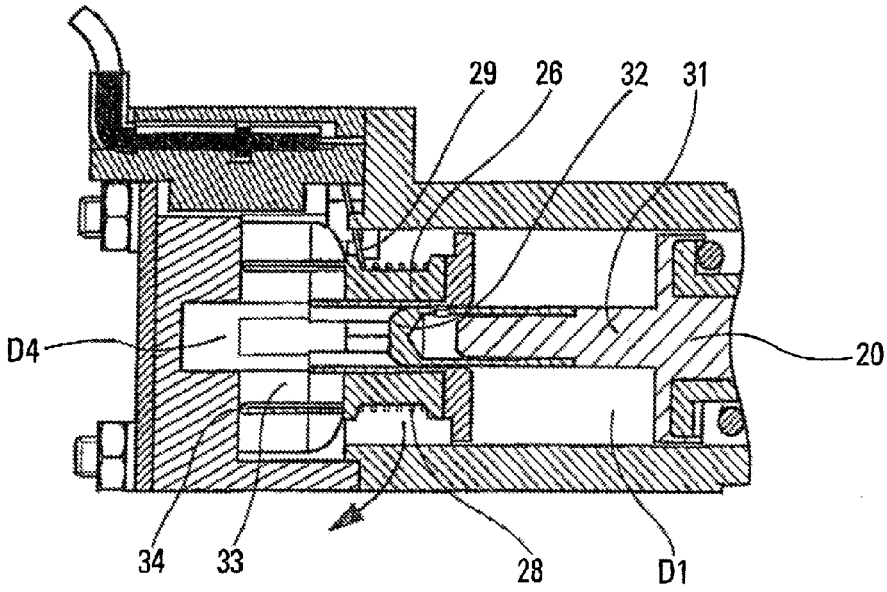
FIG. 4 is a section of a trigger element according to a third embodiment.

FIG. 4 shows a variant of the embodiment shown in FIG. 3. The principle is identical, except for the manner of functioning of the tappets 26. As in the preceding embodiment, the metal pin supports itself on the tappets 26, but, contrary to the preceding embodiments, the tappets 26 are not guided into the coil 27 when they separate. In fact, the tappets 26 have an arm 33, which has an edge at its end supporting itself in the groove 34 cut into the end of the trigger 10. As in the preceding embodiment, the tappets are held in position by a retaining wire 28 hooked on one side on the coil and on the other side on a fusible element 29. Similarly, according to the present embodiment, the tappets 26, which number three, are fitted opposite one another. Nevertheless, depending on the size of the application, the use of a single or several tappets is possible in conjunction with a bevelled metal pin.

When an electric current in excess of a given threshold passes through the fusible element 29, the latter melts, sets free the retaining wire 28, which unrolls and makes possible the separation of the tappets 26 by a pivoting movement, as shown by the arrow F, thanks to the form of the support between the metal pin 32 and the bevelled interior part of the tappets 26. The metal pin 32 then moves into the space D4 in the end part of the trigger 10.

Figure 5:
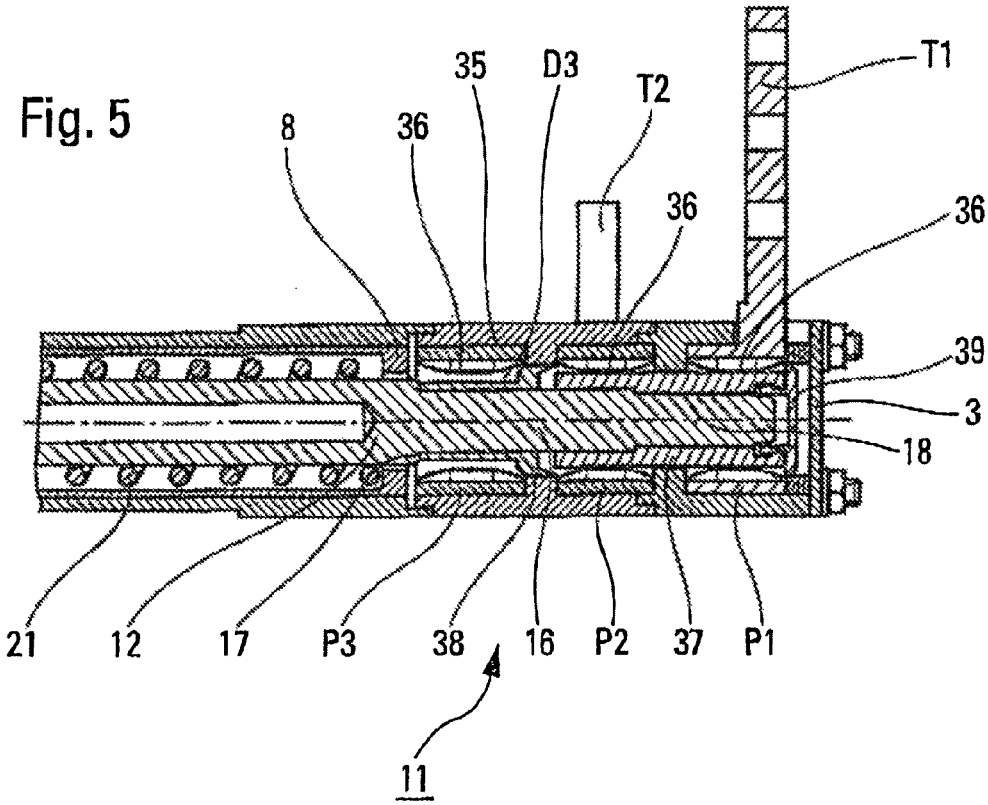
FIG. 5 is a section of a reversing switch element according to a first embodiment.

FIG. 5 shows a first embodiment of the reversing switch 11. On the surface of posts P1-P3 seated in the recesses 35 cut into the internal surface 6 of the housing 2 made of an insulating material, are fastened circular metal contact strips 36 of the type manufactured by Multi-Contact AG. These contacts project into space D3 of the housing into which the pin 16 of the plunger shaft 12 is transposed.

The reversing switch 11 is also equipped with a jacket 37, whose fastening is operated by screwing on the threaded part 18 of the pin 16 of the plunger shaft 12. A final positioning and locking strut 38 of the jacket is seated between the first end of the jacket 37 and the bevel 17 of the shaft. A shim 39 is located between a second end of the jacket 37 and the movable sealing part 3 of the housing.

If the jacket 37 is conducting, the strut 38 as well as the shim 39, are made of an insulating material, in order to achieve the insulation of the conducting jacket 37 from the neighbouring post P1 and the sealing part 3.

Clearly, the jacket 37 can be fastened by any means other than screwing, for example by using clips, since this operation makes possible its subsequent replacement.

In normal functioning, that is to say when the plunger shaft is held in sheathed position by the trigger, the supply circuit is established by connecting the jacket 37 and the contacts 36 which equip the posts P1 and P2, so providing electrical continuity of the circuit. In the event of an incident on the battery elements, the trigger 10 sets free the plunger shaft 12 which under the action of the slackening of the spring 21 is transposed, enabling the conducting jacket 37 to establish the connection between the contacts 36 which equip the posts P2 and P3, so providing the electrical continuity of the by-pass circuit.

Figure 6:
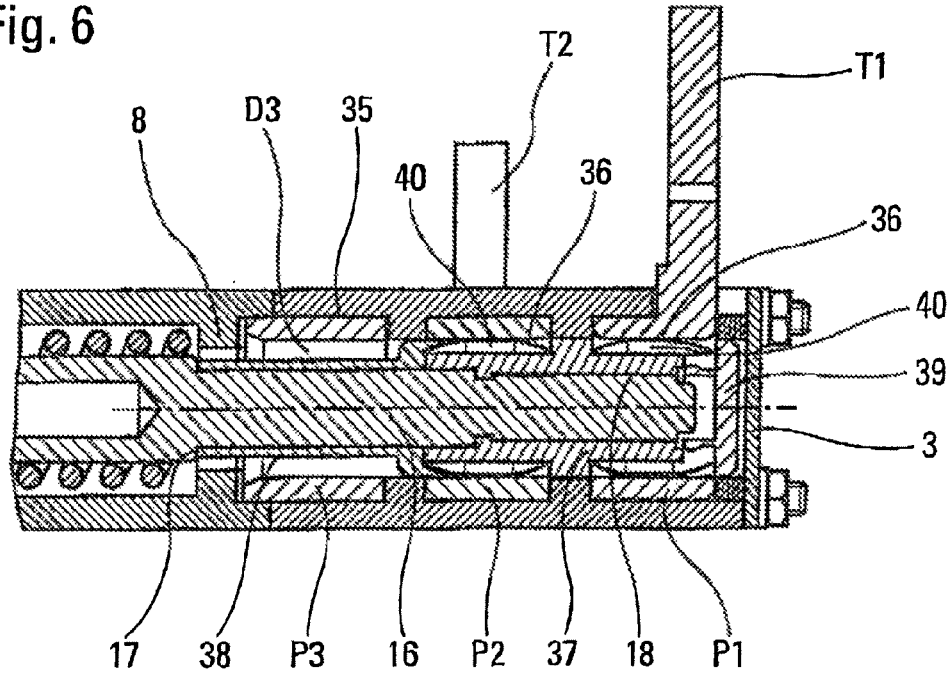
FIG. 6 is a section of a reversing switch element according to a second embodiment.

FIG. 6 shows a second embodiment in which two circular metal contact 36 are each positioned in a recess 40 cut into the outside surface of the conducting jacket 37. As in the preceding embodiment, the contacts project into the space D3 of the housing into which the pin 16 is transposed. In normal functioning, that is to say, when the plunger shaft is held in a sheathed position by the trigger, the supply circuit is established by the connection of the jacket 37 carrying the contacts 26 and the posts P1 and P2. In the event of an incident on the battery element, the trigger 10 sets free the plunger shaft 12 which is transposed under the action of the slackening of the spring 21, allowing the jacket 37 to establish the connection between the contacts 36 carried by the jacket and the posts P2 and P3, so providing the by-pass.

According to a variant of the embodiment, the width and the spacing of the posts P1, P2 and P3 with respect to the conducting jacket 37 are of a size such as to allow either the isolation or short-circuiting of the three posts during commutation.

FIGS. 7*a* and 7*b* show a third embodiment in which the pin 16 receives on its threaded end part 18 a jacket in the form of a seating 41, which is locked between the strut 38 surrounding the pin 16 and the shim 39, making it possible to position the keys 42 made of conducting material arranged concentrically in the seating 41, as shown in FIG. 7*b*. The keys are held in place with the help of a snap ring 43 and can be kept in compression during functioning with the help of the circular springs 44 positioned in the seating 41 and acting on the keys 42. As in the preceding embodiment, the keys assembly provides electrical continuity by the connection of the posts P1, P2 and P3 depending on the position of the plunger shaft.

According to a first variant of the present third embodiment, each of the key 42 is kept in compression by an individual spring in the seating 41.

According to a second variant of the present third embodiment, the keys 42 are made of beryllium bronze and provided with an incorporated spring arm, which keeps every key equipped in this way in compression with the help of an individual spring positioning itself in the seating 41 during the fitting of the key.

The disclosed embodiments are not limited to the characteristics of the devices described but, on the contrary, comprises any device making possible the assembly, the disassembly and the replacement of elements constituting a modular by-pass device of an electrical component.

The invention claimed is:

1. A modular by-pass device of an electrical component comprising:

a housing comprising:

a movable means of sealing; and a plurality of conducting terminals, each having an end connected to an electrical component circuit, and each having another end fastened to a wall of the housing and projecting into an interior of the housing to form a contact post, an actuator providing transposition between two positions of a control device comprising a plunger shaft and a spring arranged in a space formed between the plunger shaft and an internal wall of the housing, a trigger comprising:

a retention device of the plunger shaft held in place by a fusible material, and an adapter held in a central bore of the plunger shaft, and a reversing switch comprising a contact zone providing electrical continuity between at least two of the contact posts of the terminals, wherein the plunger shaft of the actuator is a one-piece shaft equipped with a shoulder comprising an end with a cylindrical part in the form of a barrel comprising the central bore and a first seating providing replacement and fastening of the trigger, and wherein the adapter comprises a post carrying an ogival first pin supported by at least one tappet, the said at least one tappet fitted in a coil and held in a locked position by a retaining wire hooked on the fusible material.

2. A modular by-pass device according to claim 1, wherein the shoulder comprises another end having a cylindrical portion in the form of a second in providing replacement and fastening of the reversing switch.

3. A modular by-pass device according to claim 2, wherein the reversing switch comprises a jacket held in place by screwing into a thread of the second pin.

4. A modular by-pass device according to claim 3, wherein the jacket is conducting and provides electrical continuity between the at least two contact posts depending on a position of the plunger shaft.

5. A modular by-pass device according to claim 4, wherein an insulating strut and an insulating shim provide positioning and locking of the conducting jacket.

6. A modular by-pass device according to claim 3, wherein the jacket comprises a second seating for receiving keys made of conducting material.

7. A modular by-pass device according to claim 6, wherein the keys are held in place by a snap ring.

8. A modular by-pass device according to claim 6 wherein the keys are kept in compression with springs positioned in the second seating.

9. A modular by-pass device according to claim 6, wherein each of the keys is kept in compression with individual springs positioned in the second seating.

10. A modular by-pass device according to claim 6, wherein each of the keys is kept in compression with an integrated individual spring positioned in the second seating.

11. A modular by-pass device according to claim 2, wherein the at least two contact posts are equipped with circular metal contact strips projecting into the interior of the housing.

12. A modular by-pass device according to claim 11, wherein the conducting jacket comprises recesses for positioning the circular metal contact strips projecting into the interior of the housing.

13. A modular by-pass device according to claim 1, wherein the adapter is held by screwing into a thread of the first seating of the plunger shaft.

14. A modular by-pass device according to claim 1, wherein the adapter is held by friction in the central bore of the first seating of the plunger shaft.

15. A modular by-pass device according to claim 1, wherein on the melting of the fusible material, the tappets separate by a lateral sliding movement.

* * * * *